US007393113B2

(12) United States Patent
Damrau

(10) Patent No.: US 7,393,113 B2
(45) **Date of Patent: *Jul. 1, 2008**

(54) ILLUMINATING NECKLACE

(76) Inventor: Steve Damrau, 14615 - "C" St., South, Tacoma, WA (US) 98444

( * ) Notice: Subject to any disclaimer, the term of this patent is extended or adjusted under 35 U.S.C. 154(b) by 0 days.

This patent is subject to a terminal disclaimer.

(21) Appl. No.: 11/677,046

(22) Filed: Feb. 20, 2007

(65) Prior Publication Data

US 2007/0297164 A1 Dec. 27, 2007

Related U.S. Application Data

(63) Continuation of application No. 11/158,954, filed on Jun. 21, 2005, now Pat. No. 7,178,930.

(60) Provisional application No. 60/655,944, filed on Feb. 23, 2005.

(51) Int. Cl.
*F21V 21/08* (2006.01)

(52) U.S. Cl. ..... 362/104; 362/391

(58) Field of Classification Search ..... 362/103, 362/104, 108, 184, 231, 237, 242, 249, 251, 362/252, 391, 806; 63/1.11, 12
See application file for complete search history.

(56) References Cited

U.S. PATENT DOCUMENTS

| | | | | |
|---|---|---|---|---|
| 2,798,148 | A | 7/1957 | Dilizio et al. | |
| 3,805,047 | A | 4/1974 | Dockstader | |
| 4,096,552 | A | 6/1978 | Ben-Porat | |
| 4,170,036 | A | 10/1979 | Sussel | |
| 4,296,459 | A | 10/1981 | DeLuca | |
| 4,309,743 | A | 1/1982 | Martin | |
| 4,779,172 | A | 10/1988 | Jimenez et al. | |
| 4,802,070 | A | 1/1989 | Westmoland | |
| 4,894,757 | A | 1/1990 | Frusha et al. | |
| 4,930,052 | A | 5/1990 | Beige | |
| 5,477,433 | A | 12/1995 | Ohlund | |
| 5,685,635 | A | 11/1997 | Barthelmess | |
| 6,296,364 | B1 | 10/2001 | Day et al. | |
| 6,578,981 | B2 | 6/2003 | Jackson et al. | |
| 2005/0185400 | A1 | 8/2005 | Hsu | |
| 2006/0232970 | A1 * | 10/2006 | Cheng | 362/252 |

* cited by examiner

*Primary Examiner*—Y M. Lee
(74) *Attorney, Agent, or Firm*—R. Reams Goodloe, Jr.

(57) ABSTRACT

An illuminated necklace. The necklace has a plurality of ornamental lamp fixtures, some of which include light emitting devices therein. The light emitting devices are switched on and off in excess of 100 times per minute. The ornamental lamp fixtures may be provided in the shape of shamrocks, hearts, pumpkins, a bulbous form, or other desired shapes. The light emitting device may emit light of the same or of a different color than the ornamental lamp fixture in which it is housed.

20 Claims, 4 Drawing Sheets

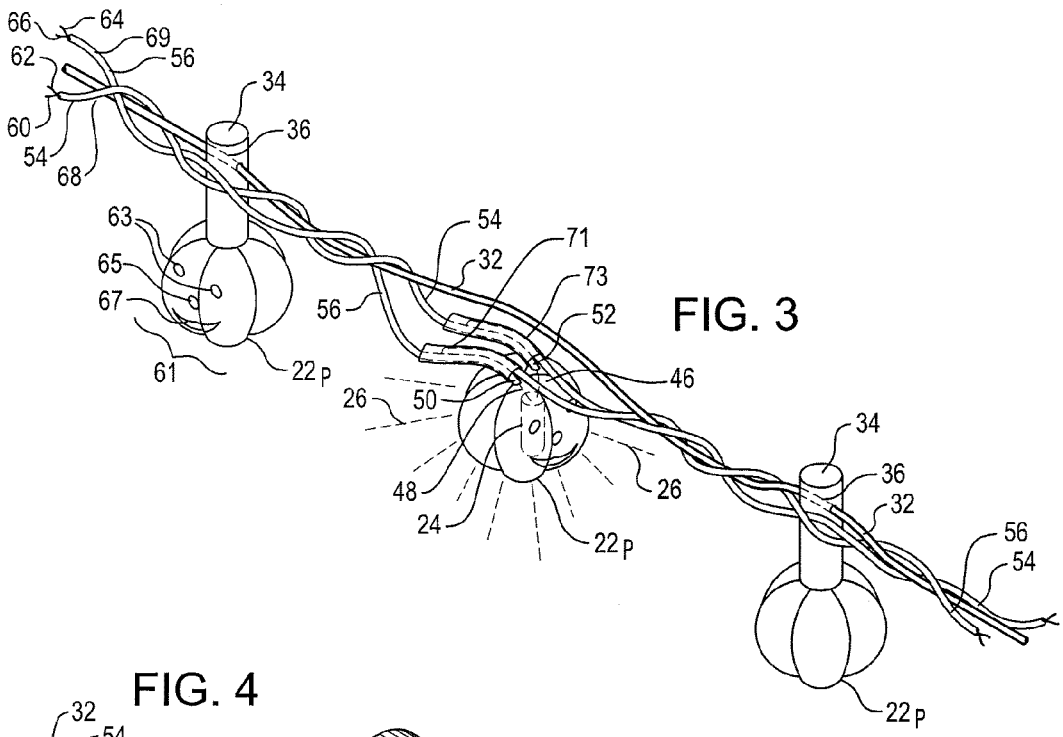
FIG. 3
FIG. 4
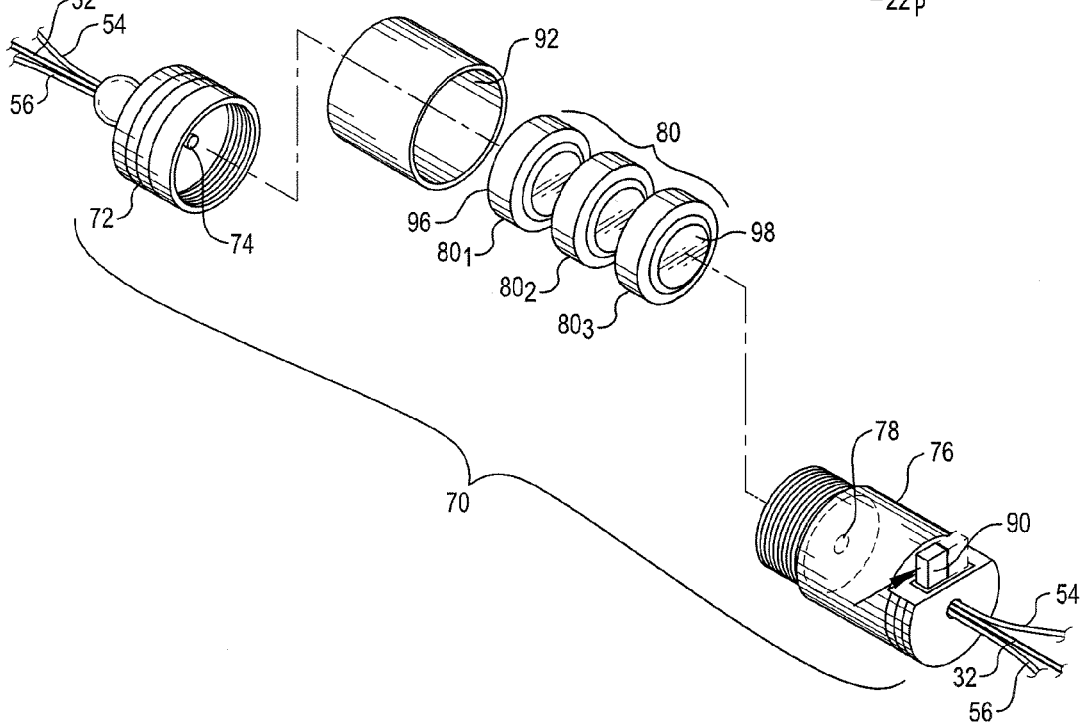

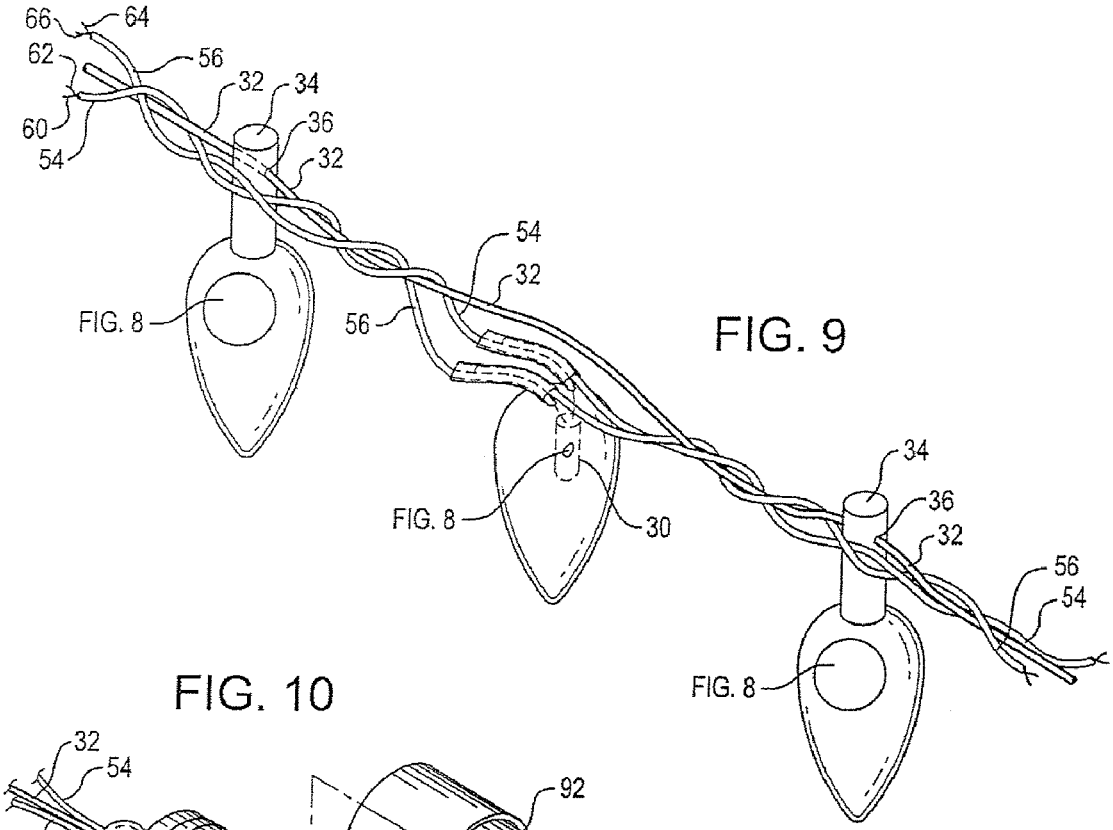
FIG. 10
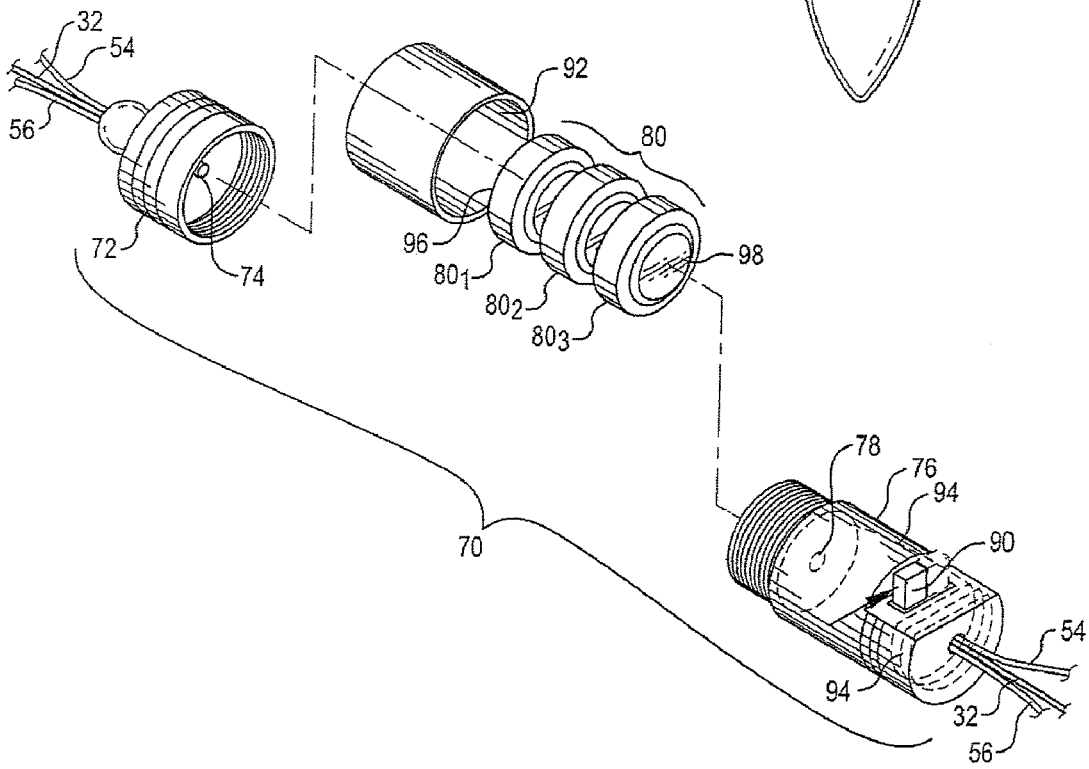

ILLUMINATING NECKLACE

RELATED PATENT APPLICATIONS

This application claims priority from, and is a continuation of prior U.S. patent application Ser. No. 11/158,954 filed Jun. 21, 2005 (issued as U.S. Pat. No. 7,178,930B2 on Feb. 20, 2007), entitled "ILLUMINATING NECKLACE", which claimed priority from prior U.S. Provisional Patent Application Ser. No. 60/655,944, filed Feb. 23, 2005, the disclosures of each of which are incorporated herein in their entirety by this reference.

COPYRIGHT RIGHTS IN THE DRAWING

A portion of the disclosure of this patent document contains material that is subject to copy right protection. The patent owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This disclosure is describes a development in the field of illuminated jewelry.

BACKGROUND

Various attempts to provide illuminated pendants and necklaces have been provided in the novelty toy industry. However, many of such devices suffer from lack of battery life, or from lack of variation in color, or from lack of available choices in the shape or visual appearance of the ornamental lamp fixtures available. Consequently, with respect to devices for providing illuminated jewelry there remains room for additional unique devices, especially for devices which would include special occasion lamp fixture designs for amusement of the user and onlookers. Moreover, it would be advantageous to provide an apparatus which provides structures which allows continued use of cost effective materials of construction, and with respect to which it is easy to change batteries for continued or repeated usage. And, it would be advantageous to provide a simple control apparatus for efficiently and reliably controlling illumination frequency of such devices.

BRIEF DESCRIPTION OF THE DRAWING

In order to enable the reader to attain a more complete appreciation of the invention, and of the novel features and the advantages thereof, attention is directed to the following detailed description when considered in connection with the accompanying figures of the drawing, wherein:

FIG. 3 is a detailed partial perspective view of one embodiment for an illuminating necklace, wherein an ornamental lamp fixture having a light emitting device therein is located between two ornamental lamp fixtures which do not have a light emitting device therein.

FIG. 4 is an exploded perspective view of a threadably closeable battery housing, and flexible battery casing with a plurality of batteries in series therein, and an on-off switch adjacent one end of the battery housing.

FIGS. 8A, 8B, 8C, 8D, 8E, 8F, 8G, and 8H represent some of the different colors possible for ornamental lamp fixtures of the present invention, and as further illustrated in FIG. 9 below, some the different colors possible for the light emitting device locating in a selected ornamental lamp fixture.

FIG. 9 is similar to FIG. 3, but now shows the use of bulbuous ornamental light fixtures, as well as indicates the possibility that the color of the light emitting device within a selected ornamental lamp fixture need not be the same as the color of the translucent ornamental light fixture itself.

FIG. 10 is a partially exploded perspective view of a threadably closeable battery housing, and flexible battery casing with a plurality of batteries in series therein, and an on-off switch adjacent one end of the battery housing, as well as indicating the location, adjacent one end of the battery housing, for an electrical power switching circuit for intermittently energizing and de-energizing differential voltage between a pair of flexible electrical conductors, to energize and de-energize each of the light emitting devices, to provide a blinking illuminated necklace.

Figure 1:
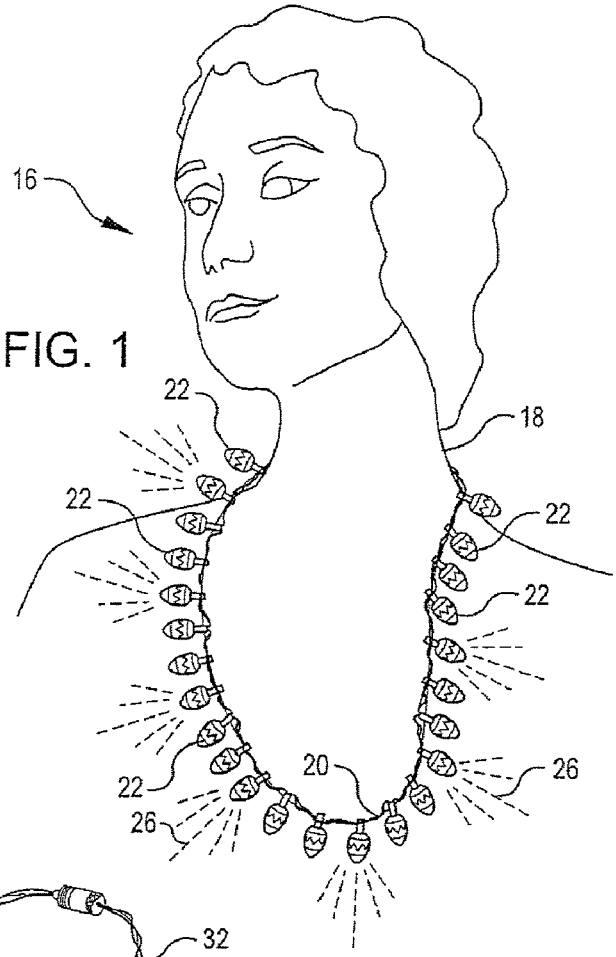
FIG. 1 is a perspective view of an illuminating necklace in use, shown around the neck of a user.

The foregoing figures, being merely exemplary, contain various elements that may be present or omitted from actual implementations and structural configurations as generally taught herein, depending upon the circumstances. In the various figures of the drawing, numerals representing like parts may be used throughout all of the applicable figures without the need for additional or specific mention thereof in relation to any particular figure of the drawing. An attempt has been made to draw the figures in a way that illustrates at least those elements that are significant for an understanding of the various embodiments and aspects of the invention. However, various elements of the unique illuminated necklace, including optional or alternate features, may be utilized in order to provide a finished apparatus having the unique features taught herein.

DESCRIPTION

Attention is now directed FIG. 1, in which one embodiment is provided showing a user 16 wearing around her neck 18 an illuminated necklace 20 that is provided with plurality of lamp fixtures 22. As further illustrated in FIG. 2, lamp fixtures 22 may include a blinking light emitting device 24 which discharges light 26 such as a light emitting diode ("LED") 30 or other illuminating device within lamp fixture 22 so that ornamental lamp fixture 22 is illuminated, thereby emitting light 26. Alternately, a lamp fixture 22 may be left without a blinking LED 30 or other blinking light emitting device 24 within the lamp fixture 22. In such cases, the lamp fixture 22, though decorative, is not illuminated, even though other lamp fixtures 22 in necklace 20 are illuminated.

Figure 2:
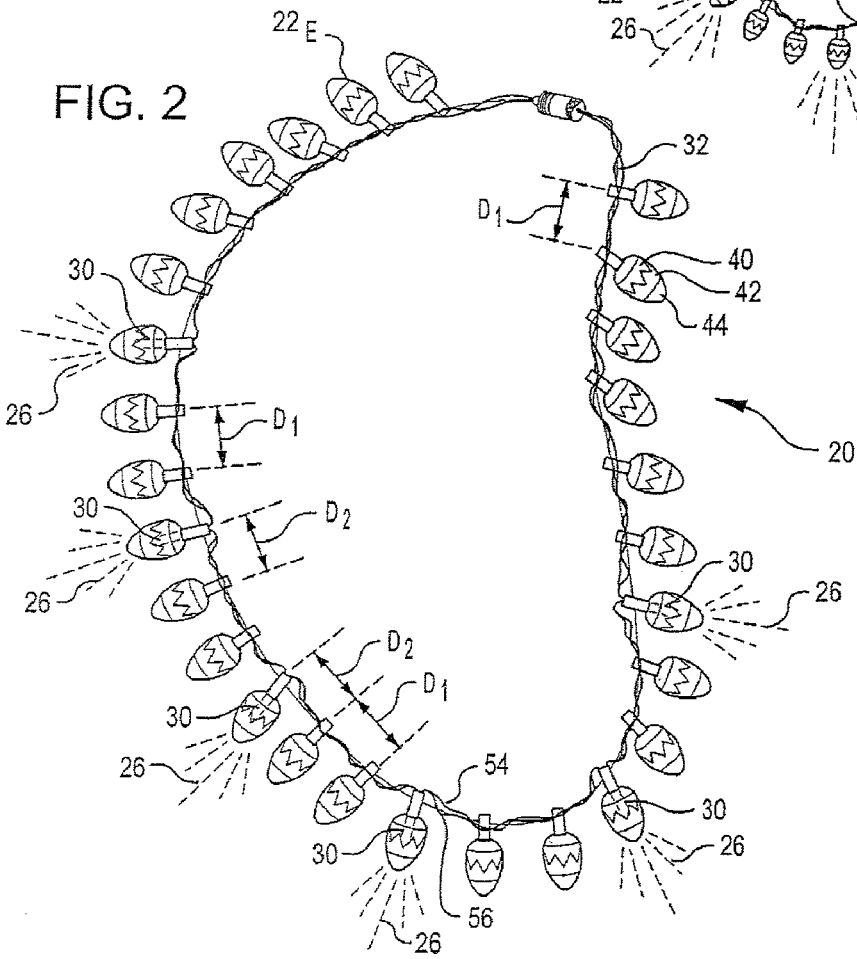
FIG. 2 is a perspective view of an illuminating necklace, shown as if with the blinking light emitting devices are energized and emitting visible light.

The illuminated necklace 20 includes a plurality of ornamental lamp fixtures 22, at least some of which have a light emitting device 24 located therein which emit light 26, Light 26 may be white, or may be colored, as further discussed below. The illuminated necklace 20 includes an elongated flexible support member 32, which is adapted for attachment to at least some, but not necessarily all, of the plurality of ornamental lamp fixtures 22. In one embodiment, attachment of flexible support member 32 to lamp fixtures 22 may be accomplished by attaching support member 32 to attachment bases, such as lamp fixture sockets 34, into which lamp fixtures 22 are mounted. Such attachment may be accomplished by running a flexible support member 32 in the form of a thread or threaded strand through a support member receiving aperture 36 which runs through the lamp fixture sockets 34. A suitable glue or adhesive can be utilized to fix support member 32 to a particular lamp fixture socket 34. In this fashion, the ornamental lamp fixtures 22 are located at spaced apart locations having a selected spaced apart distance $D_1$ between lamp fixture sockets 34 which secure the ornamental lamp fixtures 22. Alternately, lamp fixtures 22, can be provided not attached to support member 32, but still spaced so that a selected distance $D_2$ is provided between a lamp fixture socket 34 and a lamp fixture 32. As shown in FIG. 2, $D_1$ is equal to $D_2$, or roughly so, but alternate spacing for $D_1$ or $D_2$ can be provided as desired by the designer of a particular embodiment.

Figure 5:
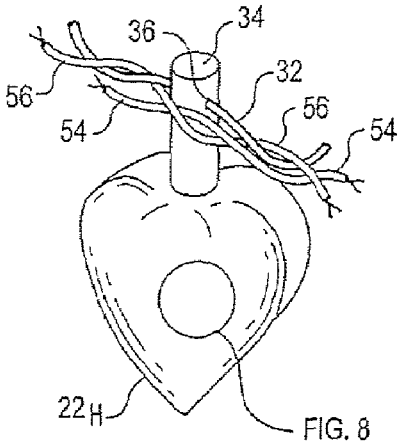
FIG. 5 is a detailed partial perspective view showing one embodiment for ornamental lamp fixtures for an illuminating necklace, wherein an ornamental lamp fixture having a heart shape is provided.
Figure 6:
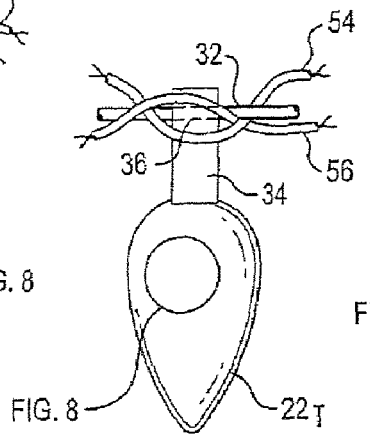
FIG. 6 is a detailed partial perspective view showing one embodiment for ornamental lamp fixtures for an illuminating necklace, wherein an ornamental lamp fixture having a bulbous shape is provided.
Figure 7:
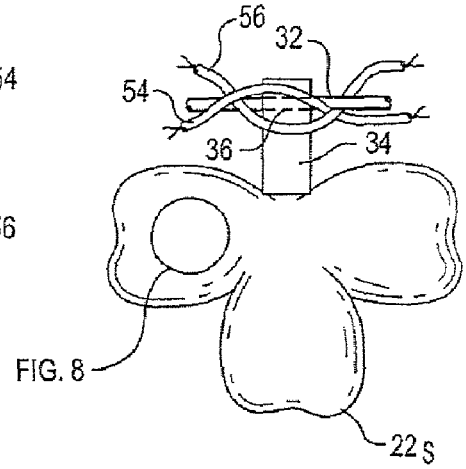
FIG. 7 is a detailed partial perspective view showing one embodiment for ornamental lamp fixtures for an illuminating necklace, wherein an ornamental lamp fixture having a shamrock shape is provided.

The ornamental lamp fixtures 22 can be provided in a variety of shapes. Some exemplary configurations include the egg like shape $\mathbf{22}_E$ shown in FIGS. 1, and 2, or a pumpkin shape $\mathbf{22}_P$ as shown in FIG. 3, or heart shape $\mathbf{22}_H$ as depicted in FIG. 5, or teardrop or bulbous shape $\mathbf{22}_T$ shown in FIG. 6, or shamrock shape $\mathbf{22}_S$ as shown in FIG. 7. The lamp fixtures 22 may be manufactured in a suitable and preferably durable material, such as acrylic or another glass like or impact resilient material, especially translucent or transparent materials suitable for being molded in a desired shape and color.

Each of the ornamental lamp fixtures 22, including lamp fixtures $\mathbf{22}_E$, $\mathbf{22}_P$, $\mathbf{22}_H$, $\mathbf{22}_T$, or $\mathbf{22}_S$ can be provided in a desired or customary color. For example, the pumpkin shape $\mathbf{22}_P$ can be provided in a transparent orange color. Likewise, the heart shaped lamp fixture $\mathbf{22}_H$ can be provided in a transparent red color. Also, the shamrock shaped lamp fixture $\mathbf{22}_S$ as can be provided in a transparent green color. And, as suggested by the designs shown in FIGS. 1 and 2 for egg like shape lamp fixtures $\mathbf{22}_E$, a lamp fixture may be provided in a multi-color configuration, for example, where one portion 40 is red, and another portion 42 is yellow, and a further portion 44 is blue. More generally, the color of one of the plurality of ornamental lamp fixtures may be selected from one of the following: (a) red or pink, or (b) brown, or (c) violet or purple, or (d) green, or (e) blue, or (f) gray or silver, or (g) orange, or (h) yellow or gold, or (i) black.

Figure 8:
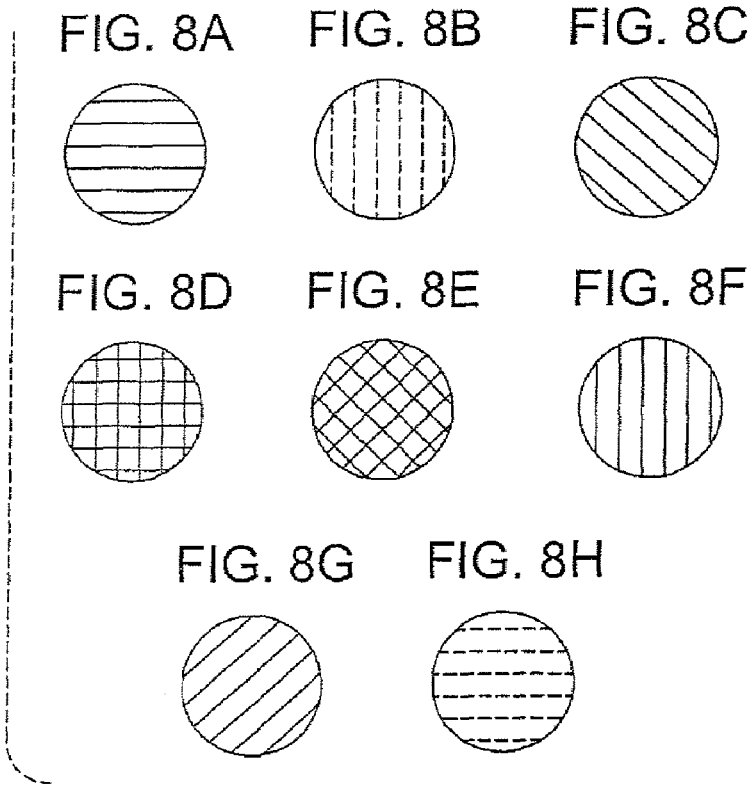
FIG. 8 is a color key, indicating some of the many colors in which an ornamental lamp fixture can be provided.

Light emitting devices 24 may be provided in a suitable plastic or glass that can be manufactured with inherently pigmented material of a desired color. In other words, the light emitting device 24 such as an LED may or may not emit light 26 having the same color as the lamp fixture 22. Thus, relating FIG. 9 to FIG. 8, by way of the colors shown for light emitting device 30 in FIG. 9, FIG. 8A shows a blue lamp. FIG. 8B shows a violet or purple lamp. FIG. 8C shows a green lamp. FIG. 8D shows a yellow or gold lamp. FIG. 8E shows an orange lamp. FIG. 8F shows a red or pink lamp. FIG. 8G shows a brown lamp. FIG. 8H shows a silver or gray lamp. Actually, there may be many variations in shades or colors. For example, the color of light emitted from one of the light emitting devices 24 may be selected from one of the following: (a) red or pink, or (b) violet or purple, or (c) green, or (d) blue, or (e) white, or (f) orange, or (g) yellow or gold.

Attention is now directed to FIG. 3. To power the light emitting devices 24, the light emitting devices in one embodiment each include a pair of conductive elements 46 and 48, which are electrically connected to first 54 and second 56 electrical conductors, respectively, which make up a pair of electrical conductors. As shown, first electrical conductor 54, in one embodiment, includes first 60 and second 62 thin flexible wires. Second electrical conductor 56 includes third 64 and fourth 66 thin flexible wires. First 60 and second 62 thin flexible wires are covered with a soft insulating material 68. Third 64 and fourth 66 thin flexible wires are covered with a soft insulating material 69. Electrical junctions between conductive element 50 and second electrical conductor 56 is electrically insulated by tightly wrapped insulating jacket 71. Electrical junction between conductive element 52 and the first electrical conductor 54 is electrically insulated by tightly wrapped insulating jacket 73. For flexibility of the illuminated necklace 20, the thin flexible wires 60, 62, 64, and 66 must be chosen from a flexible conductive wire strand material, since it is generally undesirable to have a "stiff" illuminated necklace that does not readily "lie down" against user 16, and move as the user 16 moves. In one embodiment illustrated, the first 54 and second 56 electrical conductors bypass all of the at least some ornamental lamp fixtures 22 which do not include a light emitting device 24. In the embodiments illustrated, the first 54 and second 56 electrical conductors are substantially co-extensive with the elongated flexible support member 32.

As particularly depicted in FIG. 3, note that first 54 and second 56 electrical conductors may be wrapped about the elongated flexible support member 32, so that even though an ornamental lamp fixture $\mathbf{22}_P$ is not attached to a support member 32, the unattached lamp fixture $\mathbf{22}_P$ is spaced equally between adjacent lamp fixtures $\mathbf{22}_P$ that are affixed to support member 32, as well as being supported, via first 54 and second 56 electrical conductors, adjacent the elongated flexible support member 32. As illustrated, unattached lamp fixtures include light emitting devices 24 to emit light 26, and the attached lamp fixtures do not include light emitting devices to emit light. In one embodiment, the lamp fixtures 22 which do not include light emitting devices 24 are similar in appearance to adjacent lamp fixtures which do emit light 26. In another embodiment, the lamp fixtures 22 which do not include light emitting devices 24 are dissimilar in color with respect to adjacent ornamental lamp fixtures, in which case light 26 of different colors may be provided. Also, in one embodiment, each of the ornamental lamp fixtures may have a similar size and shape—such as the use of all heart shaped lamp fixtures $\mathbf{22}_H$, or all shamrock shaped lamp fixtures $\mathbf{22}_S$, or all pumpkin shaped lamp fixtures $\mathbf{22}_P$. And, where suitable, such as in the case of transparent pumpkin shaped lamp fixtures $\mathbf{22}_P$, a suitable design, such as a face, 61, may be provided, having a pair of eyes 63, a nose 65, and a mouth 67 (see FIG. 3).

As shown, the pair of electrical conductors, namely first 54 and second 56 electrical conductors, are arranged to electrical supply power in parallel to each one of the light emitting devices 24. In this way, all of the light emitting devices 24 can be energized and de-energized, i.e., turned on and off, at the same time, yet, if one of the light emitting devices 24 no longer is operative, the remainder of the light emitting devices will remain operative, unlike in serial lighting circuits.

As shown in FIG. 4, a battery housing 70 having a first portion 72 with a positive battery contact 74 therein, and a second portion 76 with a negative battery contact 78 therein, are provided. In electrical connection with battery 80, a suitable electrical power switching circuit 94 is provided. The electrical switching circuit may be contained within battery housing 70, or may be adjacent the battery housing 70, or may be at least partially contained within the battery housing 70. The electrical power switching circuit 94 intermittently energizes and de-energizes a differential voltage between first 54 and second 56 of the pair of flexible electrical conductors, to energize and de-energize each of the light emitting devices 24, so that a blinking illuminated necklace 20 is provided, and wherein the light emitting devices 24 blink in unison. In one embodiment, the rate of blinking of the light emitting devices is at least 100 times per minute. In another embodiment, the rate of blinking of the light emitting devices is between about 130 times per minute and about 170 times per minute. As illustrated in FIG. 2, between each ornamental lamp fixture 22 having a light emitting device 24 therein, two or more ornamental lamp fixtures 22 are provided not having a light emitting device 24 therein. Also as shown in FIGS. 1 and 2, the illuminated necklace 20 may include 6 or more light emitting devices 24.

As further seen in FIGS. 4 and 10, the battery housing 70 can be provided further including an on-off switch 90, shown in the "off" position in solid lines, and in the "on" position in hidden lines. The battery 80 may in fact include a plurality of batteries such as $\mathbf{80}_1$, $\mathbf{80}_2$, and $\mathbf{80}_3$, which may be disposed electrically in a series fashion within the battery housing 70. When such a plurality of batteries is utilized, a flexible battery casing 92 can be utilized to contain the same. The battery casing 92 is, in the embodiment illustrated, a tubular member sized and shaped for receiving in close mating engagement the plurality of batteries $\mathbf{80}_1$, $\mathbf{80}_2$, and $\mathbf{80}_3$. The battery casing 92 is arranged so that a first positive 96 and second negative 98 electrical contact surfaces for battery 80 remain exposed outside of the tubular member battery casing 92. The battery casing is sized and shaped so that the flexible battery casing 92 is sized and shaped for securing the plurality of batteries $\mathbf{80}_1$, $\mathbf{80}_2$, and $\mathbf{80}_3$ as a unitary battery 80 within the battery housing 70.

In one embodiment, the illuminated necklace as illustrated utilizes three (3) batteries $\mathbf{80}_1$, $\mathbf{80}_2$, and $\mathbf{80}_3$in series, each of which is 1.5 volts, so as to deliver 4.5 volts, when the batteries $\mathbf{80}_1$, $\mathbf{80}_2$, and $\mathbf{80}_3$are at full charge. Due to the relatively low current draw, the batteries can last 5 to 6 hours during continuous use—that is, while the on-off switch 90 remains on and the blinking necklace blinks on and off. Such a capability can be provided by a flasher or oscillator integrated circuit device. A simple integrated circuit can be used in an electrical switching circuit 94 to get the light emitting devices 24 to flash on and off at a constant rate. To get a light emitting device 24 to flash on and off at a relatively constant rate, such a flasher integrated circuit uses an electronic timer to control the flash rate of the light emitting device 24. In one embodiment, an electronic timer can be provided which contains a resistor to restrict current flow so that a capacitor charges up slowly. In such an embodiment, the capacitor is charged to a preselected voltage level, and then a transistor starts to conduct electricity to the light emitting devices 24. The capacitor is discharged, eventually shutting off the transistor at the end of the voltage fall. Then, once the capacitor is discharged, it shuts off the transistor, and thus de-energizes the light emitting devices 24. At that point, the capacitor starts charging again. Once charged, the capacitor is discharged again, and the cyclic process is repeated. Thus, the light emitting devices 24 blink in unison. Those of ordinary skill in the art and to whom this disclosure is addressed will recognize that the capacity of the capacitor will determine the length of time that it takes for the capacitor to charge, and thus, determine the "dark time" interval between lightings of the light emitting devices 24. Once the capacitor reaches the voltage that was selected in the design for a particular circuit, then a transistor conducts current from the capacitor to the light emitting devices 24, so that the light emitting devices 24 are illuminated. As the charge-discharge cycle is repeated, the lamps will blink over and over again, so long as the battery power lasts, and the circuit remains switched on. And, once a particular set of batteries is exhausted and the lamps will no longer blink, the batteries 80 may be replaced, and the illuminated necklace 20 may be used again for the life of the replacement batteries. In one embodiment, size AG3 alkaline batteries are used (equivalent voltage to type 392 silver oxide watch and calculator batteries) and in the case of the AG3 type batteries, a "blinking life" of 5 to 6 hours may easily be provided.

Although various aspects and elements of the device(s) are herein disclosed for illustrative purposes, it is to be understood that the illuminating necklace(s) described herein provide novel improvements in the field of illuminated jewelry. Although only a few exemplary aspects have been described in detail, various details are sufficiently set forth in the figures of the drawing and in the specification provided herein to enable one of ordinary skill in the art to make and use the invention(s), which need not be further described by additional writing in this detailed description. The aspects and embodiments described and claimed herein may be modified from those shown without materially departing from the novel teachings and advantages provided, and may be embodied in other specific forms without departing from the spirit or essential characteristics thereof. Therefore, the embodiments presented herein are to be considered in all respects as illustrative and not restrictive. As such, this disclosure is intended to cover the structures described herein and not only structural equivalents thereof, but also equivalent structures. Thus, the scope of the invention(s) is as described herein and as indicated by the drawing and by the foregoing description, is intended to include variations from the embodiments provided which are nevertheless described by the broad interpretation and range properly afforded to the plain meaning of the language utilized in the accompanying claims.

The invention claimed is:

1. An illuminated necklace, comprising:

a plurality of ornamental lamp fixtures, an elongated flexible support member, said elongated flexible support member adapted for attachment to at least some of said plurality of ornamental lamp fixtures;

at least some of said ornamental lamp fixtures further comprising a light emitting device;

at least some of said ornamental lamp fixtures not having a light emitting device, and wherein said at least some of said ornamental lamp fixtures not having a light emitting device further comprise an attachment base secured to said elongated flexible support member;

a battery housing, said battery housing comprising a positive battery contact and a negative battery contact and containing at least one battery;

a pair of flexible electrical conductors, said pair of flexible electrical conductors wrapped about said elongated flexible support member, said pair of flexible electrical conductors electrically attached to each of said light emitting devices, said pair of flexible electrical conductors arranged to supply power from said battery to said light emitting devices;

an electrical power switching circuit, said electrical power switching circuit intermittently providing a differential voltage between a first one and a second one of said flexible electrical conductors, thereby energizing and de-energizing said light emitting devices, so that a blinking illuminated necklace is provided.

2. The apparatus as set forth in claim 1, wherein each of said ornamental lamp fixtures comprises a fixture body, said bodies providing a visual impression of substantially identical size and shape.

3. The apparatus as set forth in claim 1, wherein said plurality of ornamental lamp fixtures are of the same color as a light emitting device located therein.

4. The apparatus as set forth in claim 1, wherein at least some of said plurality of ornamental lamp fixtures are of different color than a light emitting device located therein.

5. The apparatus as set forth in claim 1, wherein said ornamental lamp fixtures comprise a transparent orange pumpkin shaped design.

6. The apparatus as set forth in claim 5, wherein said pumpkin shaped design further comprises a pumpkin face comprising a pair of eyes, a nose, and a mouth.

7. The apparatus as set forth in claim 1, wherein said ornamental lamp fixtures comprise a transparent green shamrock shaped design.

8. The apparatus as set forth in claim 1, wherein said ornamental lamp fixtures comprise a transparent red heart shaped design.

9. The apparatus as set forth in claim 1, wherein said ornamental lamp fixtures comprise a bulbous shaped design.

10. The apparatus as set forth in claim 1, wherein the color of one of said plurality of ornamental lamp fixtures is selected from one of the following:

(a) red or pink;
(b) brown;
(c) violet or purple;
(d) green;
(e) blue;
(I) gray or silver;
(g) orange;
(h) yellow or gold; or
(I) black.

11. The apparatus as set forth in claim 1, wherein the color of light emitted from one of said light emitting devices is selected from one of the following:

(a) red or pink;
(b) violet or purple;
(c) green;
(d) blue;
(e) white;
(I) orange; or
(g)yellow or gold.

12. The apparatus as set forth in claim 1, wherein said elongated flexible member comprises a thread.

13. The apparatus as set forth in claim 1, wherein at least some of said light emitting devices blink in unison.

14. The apparatus as set forth in claim 13, wherein the rate of blinking is at least 100 times per minute.

15. The apparatus as set forth in claim 14, wherein the rate of blinking is between about 130 times per minute and about 170 times per minute.

16. The apparatus as set forth in claim 1, wherein between each ornamental lamp fixture having light emitting device therein, two or more ornamental lamp fixtures are provided not having a lamp therein.

17. The apparatus as set forth in claim 1, comprising 6 or more light emitting devices, wherein said 6 or more light emitting devices of said ornamental lamp fixtures emit light simultaneously when electrically energized.

18. The apparatus as set forth in claim 1, wherein said battery housing further comprises an on-off switch.

19. The apparatus as set forth in claim 1, wherein a plurality of batteries is provided, and wherein said plurality of batteries is disposed in series fashion within said battery housing.

20. The apparatus as set forth in claim 19, further comprising a flexible battery casing, said battery casing comprising a tubular member sized and shape for receiving in close mating engagement said plurality of batteries, said tubular member arranged so that first and second electrical contact surfaces of said batteries remain exposed outside of said tubular member, said flexible battery casing sized and shaped for securing said plurality of batteries within said battery housing.

* * * * *